United States Patent [19]

Rogers

[11] 4,338,381

[45] Jul. 6, 1982

[54] STRUCTURAL MEMBER

[76] Inventor: Frank A. Rogers, 4 Orville Pl., Hamersley, Western Australia, Australia, 6022

[21] Appl. No.: 104,840

[22] Filed: Dec. 18, 1979

[30] Foreign Application Priority Data

Dec. 22, 1978 [AU] Australia ..... PD7197

[51] Int. Cl.[3] ..... E04B 1/08

[52] U.S. Cl. ..... 428/575; 428/573; 428/577; 428/582; 52/287; 52/288

[58] Field of Search ..... 428/573, 574, 575, 577, 428/582; 52/287, 288

[56] References Cited

U.S. PATENT DOCUMENTS

| | | | |
|---|---|---|---|
| 1,446,274 | 2/1923 | Roberts | 428/573 |
| 1,731,667 | 10/1929 | Johnson | 428/573 |
| 1,999,818 | 4/1935 | McIntyre | 428/573 |
| 2,482,990 | 9/1949 | Olson | 428/575 |
| 2,484,288 | 10/1949 | Hamm | 428/575 |
| 2,619,375 | 11/1952 | Merrill | 428/597 |
| 2,668,131 | 2/1954 | Hamm | 428/596 |

*Primary Examiner*—Brooks H. Hunt

*Attorney, Agent, or Firm*—Harness, Dickey & Pierce

[57] ABSTRACT

A structural member comprising a flat strip of web of material having a plurality of slots formed at spaced intervals along each edge of the strip, the inner portion of each slot being of greater dimension than the outer portion and formed to the desired degree of curvature in the plane of the strip.

9 Claims, 5 Drawing Figures

1

STRUCTURAL MEMBER

This invention relates to a structural member.

The object of the invention is to provide a structural member which having regard to its dimensions is relatively strong and capable of spanning large distances and which may, if desire, be fabricated on site.

In one form the invention resides in a structural member comprising a flat strip or web of material having a plurality of slots formed at spaced intervals along each edge of the strip, the inner portion of each slot being of greater dimension than the outer portion and formed to the desired degree of curvature in the plane of the strip.

Preferably a tie, which may be in the form of a flange, is fixed to either or both of the concave and convex edges of the curved strip which may be formed of steel, aluminum or other suitable metal, plastic or timber. The tie may be formed by welding the other edges of the slots as they come together on the concave edge or it may be formed by the structure such as the wall of a tank or building in which the structural member is incorporated.

The invention will be better understood by reference to the following description of the specific embodiments thereof shown in the accompanying drawings wherein.

Figure 1:
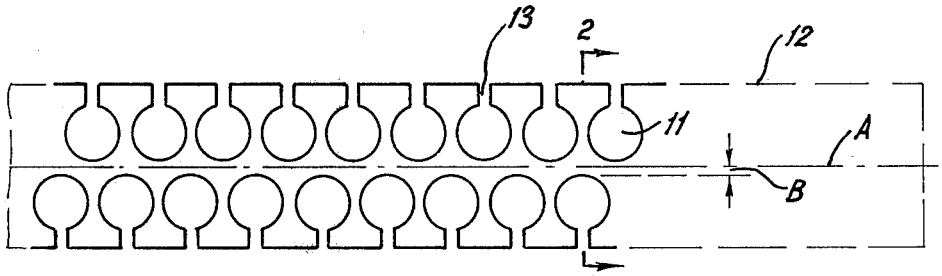
FIG. 1 is a fragmentary elevation of one embodiment prior to bending to the desired radius.
Figure 2:
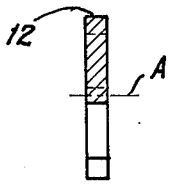
FIG. 2 is an end elevation of the embodiment of FIG. 1.

Referring now to FIGS. 1 and 2 of the drawings a series of holes 11 were drilled in a flat strip 12 of aluminium of 25 mm × 4 mm, the holes being equidistant from the neutral axis A of the strip. A series of slots 13 was then cut from each hole to the adjacent outer edge of the strip which was then hand bent in the plane of the strip to a radius of 100 mm. A flange (not shown) was then fixed to the concave and convex edges of the strip to form a structural member which could be described as a curved RSJ. In comparison with an RSJ having a curved web cut from flat plate the structural member of the present invention had similar strength, was much lighter in weight and could be constructed more readily without substantial waste of material.

Figure 3:
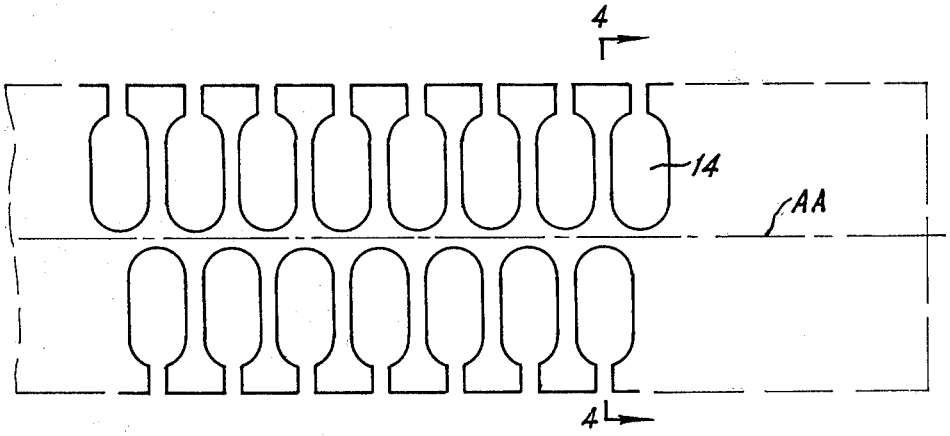
FIG. 3 is a fragmentary elevation of a second embodiment prior to bending to the desired radius.
Figure 4:
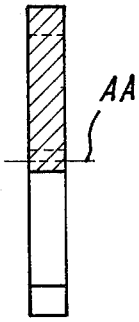
FIG. 4 is an end elevation of the embodiment of FIG. 3.

In the embodiment shown in FIGS. 3 and 4 of the slots 14 are elongated and are equidistant from the neutral axis AA of the strip. When bent to the desired curvature and flanges welded thereto the resulting structural member has similar properties to those of the structural member of FIGS. 1 and 2.

The spacing of the inner end of the slots from the neutral axis (dimension "B") in FIG. 1 determines the flexibility of the strip for bending the strip to the desired curvature. The greater the dimension "B" the more rigid is the strip. Flexibility is also controlled by the number of slots per unit length and the dimension of the outer portion of the slots which are in effect expansion—contraction gaps. The thickness of the strip does not appear to affect flexibility apart from the natural stiffness effect.

Figure 5:
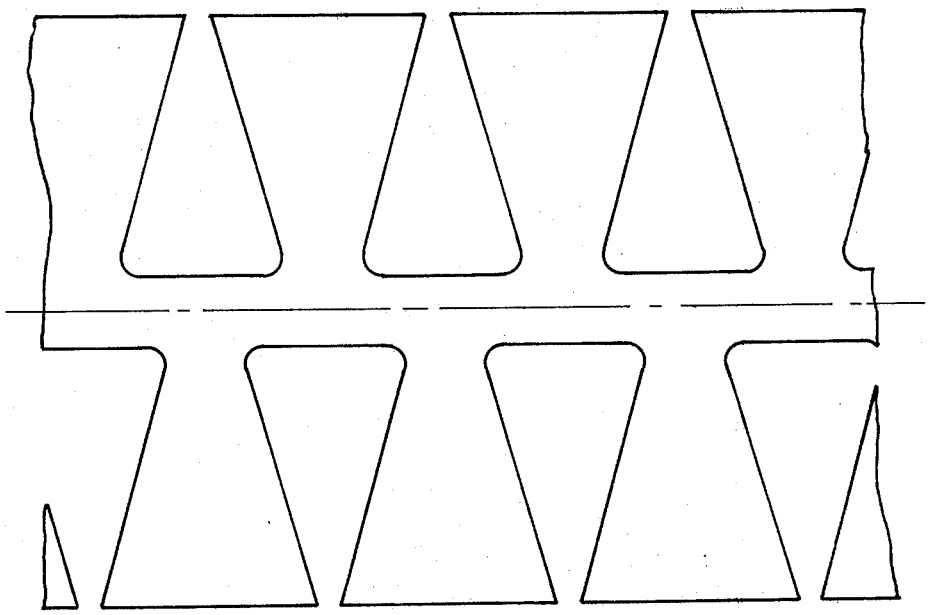
FIG. 5 is a fragmentary elevation of a third embodiment prior to bending to the desired radius.

It has been found that the width of the slot may increase progressively with depth to give a configuration as shown in FIG. 5 of the drawings. This configuration has the advantage that the pieces which are cut out to form the slot can be assembled together and welded to a flat central bar to form another structural member of the same configuration. Exhaustive analysis of structural members of the configuration shown in FIG. 4 has established that the preferred relative dimensions are as follows:

$$D/H \geqq 0.375$$

$$F/H = 0.40$$

$$B/F \geqq 0.135\text{–}0.15$$

$$B/H \geqq 0.0625$$

where

D is the distance between adjacent slots at the outer edge of the web.

B is the spacing of the inner end of the slot from the neutral axis and 2B is equal to the distance between adjacent slots at the inner end H is the depth of the member F is the width of the flange It is preferable that the slots on one edge of the structural member be staggered in relation to the slots on the other edge. This ensures a more even bending of the structural member to the desired curvature. It also ensures that there is greater strength in the area adjacent the neutral axis.

I claim:

1. A curved structural member formed from a flat strip of material having a plurality of slots formed at spaced intervals opening through opposite edges of said strip, the inner portion of each slot being the greater dimension than the outer portion prior to curvature of said strip, said strip being bent to the desired degree of curvature in the plane of said strip.

2. A structural member as claimed in claim 1 wherein a tie is fixed to at least one of the edges of the curved strip.

3. A structural member as claimed in claim 2 wherein the tie is in the form of a flange.

4. A structural member as claimed in claim 2 wherein the tie is a structure to which the structural member is attached.

5. A structural member as claimed in claim 2 wherein the tie is formed by connecting the adjacent outer edges of the slots.

6. A structural member as claimed in claim 1 wherein the inner end of each slot is circular and has a diameter greater than the width of the outer portion of the slot before the strip is curved.

7. A structural member as claimed in claim 1 wherein the width of the slot increases progressively with depth before the strip is curved.

8. A structural member as claimed in claim 7 having the following relative dimensions:

$$D/H \geqq 0.375$$

$$F/H = 0.40$$

$$B/F \geqq 0.135\text{–}0.15$$

$$B/H \geqq 0.0625$$

where

D is the distance between adjacent slots at the outer edge of the web;

B is the spacing of the inner end of the slot from the neutral axis and 2B is equal to the distance between adjacent slots at the inner end;

H is the depth of the member; and

F is the width of the flange.

9. A structural member as claimed in claim 1 wherein the slots on one edge of the flat strip are staggered in relation to the slots on the other edge.

* * * * *